US006039579A

United States Patent [19]

Paul et al.

[11] Patent Number: 6,039,579

[45] Date of Patent: Mar. 21, 2000

[54] SEALED SOCKET ASSEMBLY FOR A PLUG-IN LAMP AND A METHOD FOR ASSEMBLING SAME

[75] Inventors: Donald C. Paul, Downers Grove; Joseph C. Bennett, Lisle; Joseph A. Bettini, Naperville, all of Ill.; Edward J. Gordon, Grand Blanc, Mich.

[73] Assignee: Tricon Industries, Incorporated, Lisle, Ill.

[21] Appl. No.: 09/121,935

[22] Filed: Jul. 24, 1998

Related U.S. Application Data

[62] Division of application No. 08/603,874, Feb. 22, 1996, Pat. No. 5,800,183.

[51] Int. Cl.[7] ..... H01R 9/09

[52] U.S. Cl. ..... 439/56; 439/57; 439/557; 439/558; 439/699.2

[58] Field of Search ..... 439/699.2, 56, 439/619

[56] References Cited

U.S. PATENT DOCUMENTS

| | | | |
|---|---|---|---|
| 3,859,554 | 1/1975 | Preziosi et al. . | |
| 3,960,278 | 6/1976 | Vause . | |
| 3,999,095 | 12/1976 | Pearce, Jr. et al. . | |
| 4,012,658 | 3/1977 | Vause . | |
| 4,193,653 | 3/1980 | Aizawa . | |
| 4,428,619 | 1/1984 | Dolan et al. . | |
| 4,569,005 | 2/1986 | Bergin et al. . | |
| 4,573,754 | 3/1986 | Hill | 439/699.2 |
| 4,623,958 | 11/1986 | Van de Linde et al. . | |
| 4,752,710 | 6/1988 | Devir et al. . | |
| 4,804,343 | 2/1989 | Reedy . | |
| 4,847,531 | 7/1989 | Tsuji et al. . | |
| 4,864,185 | 9/1989 | Dayton et al. . | |
| 4,868,719 | 9/1989 | Kouchi et al. . | |
| 4,877,992 | 10/1989 | Devir . | |
| 4,883,434 | 11/1989 | Toyoshima . | |
| 4,933,816 | 6/1990 | Mohsakowski et al. . | |
| 4,940,422 | 7/1990 | Forish et al. . | |
| 4,947,078 | 8/1990 | Rice et al. . | |
| 4,947,082 | 8/1990 | French . | |
| 4,958,429 | 9/1990 | Forish et al. . | |
| 5,000,702 | 3/1991 | Forish et al. . | |
| 5,035,643 | 7/1991 | Forish et al. . | |
| 5,055,983 | 10/1991 | Hunold et al. . | |
| 5,121,304 | 6/1992 | Hall et al. | 362/61 |
| 5,130,911 | 7/1992 | Eisner, Sr. . | |
| 5,172,026 | 12/1992 | Hall et al. | 313/318 |
| 5,239,226 | 8/1993 | Seredich et al. | 313/318 |
| 5,800,183 | 9/1998 | Paul et al. | 439/56 |

*Primary Examiner*—Michael L. Gellner
*Assistant Examiner*—Briggitte R. Hammond
*Attorney, Agent, or Firm*—Hill & Simpson

[57] ABSTRACT

A plug-in lamp socket assembly is provided that maintains connections sealed to the environment between the electrical lamp leads, electrical socket contacts and circuits of the circuit carrier. The assembly has a lamp socket member for receiving a lamp in an aligned manner. A cap plate connects to the lamp socket member and is non-removable therefrom. The lamp socket has tabs that require proper alignment of the tabs for insertion into a circuit carrier having circuits molded therein. An O-ring seals the removable connection between the lamp socket, cap plate, assembly and the circuit carrier. The circuit carrier is sealed to the lens housing.

4 Claims, 5 Drawing Sheets

SEALED SOCKET ASSEMBLY FOR A PLUG-IN LAMP AND A METHOD FOR ASSEMBLING SAME

This application is a divisional of application U.S. Ser. No. 08/603,874 filed Feb. 22, 1996, now U.S. Pat. No. 5,800,183.

BACKGROUND OF THE INVENTION

The present invention generally relates to socket assemblies for lamps. More specifically, the present invention relates to electric automotive lamps, particularly used on the perimeter of the vehicle and more particularly to lamp sockets, base members and electrical connections required to provide a sealed electrical connection between electrical leads from the lamps, electrical contacts of the lamp sockets, and car wiring.

Automobile socket assemblies that are sealed to survive conditions external thereto are well-known in the art. Such socket assemblies, however, often sacrifice other requirements for the socket assembly in order to provide a sealed environment for the lamp. For example, the socket assembly often requires significant handling during manufacture of vehicles. Further, field replacement of defective lamps is often difficult for the customer and even the mechanic. Still further, many of the known lamp sockets are expensive. However, the lamp socket assembly must be capable of withstanding the conditions that the vehicle is subjected to, i.e. weather, road conditions, oil, salt, dirt, etc. Therefore, the lamp socket assembly must be durable to extreme conditions and must remain electrically sealed from such conditions.

Known lamp socket assemblies have typically failed to provide a combination of many or all of the advantages that would make an alternative lamp socket assembly more desirable and yet maintaining the seal of the lamp socket from conditions to which the lamp socket is exposed. A need, therefore, exists for an improved sealed lamp socket assembly with a replaceable lamp to overcome the deficiencies of known socket assemblies.

SUMMARY OF THE INVENTION

The present invention provides a sealed plug-in lamp socket and a method for assembling the same, and a molded circuit carrier to hold the lamp assembly, seal the car circuits, and complete the seal to the lamp reflector. The plug-in lamp socket is both simple to install and to replace and yet maintains the seal requirement of the lamps from external conditions.

To this end, in an embodiment, a plug-in lamp socket assembly is provided. The assembly comprises a lamp having a plurality of electrical leads extending therefrom. A lamp socket has a plurality of contacts corresponding to the plurality of electrical leads wherein each of the plurality of contacts electrically connect to a corresponding one of the plurality of electrical leads within an interior of the socket and further wherein each of the plurality of contacts extend around the base of a socket to rest against an outside wall of the lamp socket. A cap plate is connected to the socket wherein the cap plate has a surface substantially covering the base of the lamp socket. A circuit carrier is selectively connectable to the cap plate having a plurality of circuits molded and sealed in the circuit carrier corresponding to the plurality of contacts wherein the plurality of circuits electrically connect to the plurality of contacts of the outside wall of the lamp socket when the circuit carrier is connected to the lamp socket assembly.

In an embodiment, an O-ring is constructed and arranged between the lamp socket and the circuit carrier.

In an embodiment, a latch extends substantially perpendicular to the surface of the cap plate and an aperture in the lamp socket is capable of receiving the latch. In an embodiment, the latch is non-removable from the aperture of the lamp socket.

In an embodiment, a lens reflector is connectable to the circuit carrier.

In an embodiment, a biased arm extends substantially perpendicular from the surface of the cap plate, and an aperture in the circuit carrier is constructed and arranged to receive the biased arm extending from the surface of the cap plate.

In an embodiment, a supporting base is constructed and arranged around the lamp and inserted into the lamp socket.

In an embodiment, a biased member within the interior of the lamp socket is provided wherein the biased member supports the lamp when inserted in the interior of the socket.

In an embodiment, a stepped inner peripheral wall defines the interior of the lamp socket wherein the stepped inner peripheral wall permits insertion of the lamp in a fixed orientation to the circuit carrier.

In another embodiment of the present invention, a sealed lamp socket for connection to a lamp having electrical leads extending therefrom is provided. The sealed lamp socket has a first member having an opening into an interior thereof capable of receiving the lamp in a fixed orientation. Electrical contacts are constructed and arranged for a first portion of each of the electrical contacts to extend within the interior of the first member and a second portion of each of the electrical contacts to extend outside of the first member. A second member has circuits molded and sealed therein and an aperture wherein the first member is insertable through the aperture of the second member such that the second portion of each of the electrical contacts is electrically connected to the extended portion of the electrical contacts of the second member following insertion of the first member into the second member.

In an embodiment, a third member is securable to the first member opposite the opening into the interior and exterior to a base of the first member.

In an embodiment, a sealing member is constructed and arranged to seal the first member from the second member.

In an embodiment, means for non-removable securing the first member to the third member is provided.

In an embodiment, means for aligning the lamp in the opening of the first member is provided.

In an embodiment, means for removably securing the third member to the second member is provided.

In an embodiment, an opening in the second member is capable of receiving a portion of the first and third member allowing the first and third member to be selectively separated from the second member.

In another embodiment of the present invention, a method is provided for assembling a sealed plug-in lamp assembly. The method comprises the steps of: providing a lamp having a plurality of electrical leads extending therefrom; providing a lamp socket having an interior with a plurality of electrical contacts therein; inserting the lamp into the lamp socket providing electrical connection between the plurality of electrical leads and the plurality of electrical contacts within the interior of the lamp socket; providing a circuit carrier having a plurality of circuits molded therein; and inserting the lamp socket into the circuit carrier providing electrical connection between the plurality of contacts and the plurality of circuits exterior to the lamp socket in a sealed manner.

In an embodiment, the method further comprises the step of mounting the lamp socket on a cap plate prior to inserting the lamp socket into the circuit carrier.

In an embodiment, the method further comprises the step of providing an O-ring to seal the electrical connections.

In an embodiment, the method further comprises the step of providing means for aligning the lamp for proper insertion of the lamp into the lamp socket.

In an embodiment, the method further comprises the step of providing means for the mounting and sealing the circuit carrier to the lamp reflector or housing.

In an embodiment, the method further comprises the step of providing means for mounting the lamp in a controlled manner and retaining the lamp in the lamp socket.

It is, therefore, an advantage of the present invention to provide an assembly and a method for assembling a plug-in lamp in a lamp socket that is simple to assemble.

Another advantage of the present invention is to provide a plug-in lamp assembly and a method for assembling the same wherein the lamp is simple to replace.

Yet another advantage of the present invention is to provide a plug-in lamp assembly and a method for assembling the same that maintains the electrical connection in a sealed manner.

Yet another advantage of the present invention is to provide a plug-in lamp assembly that is inexpensive to manufacture and assemble.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a system for insertion of a sealed socket and lamp into a sealed circuit carrier fastened to a backside of a taillight reflector, or the like. The circuit carrier includes sealed circuits and one-half of a sealed, molded connector.

Figure 1:
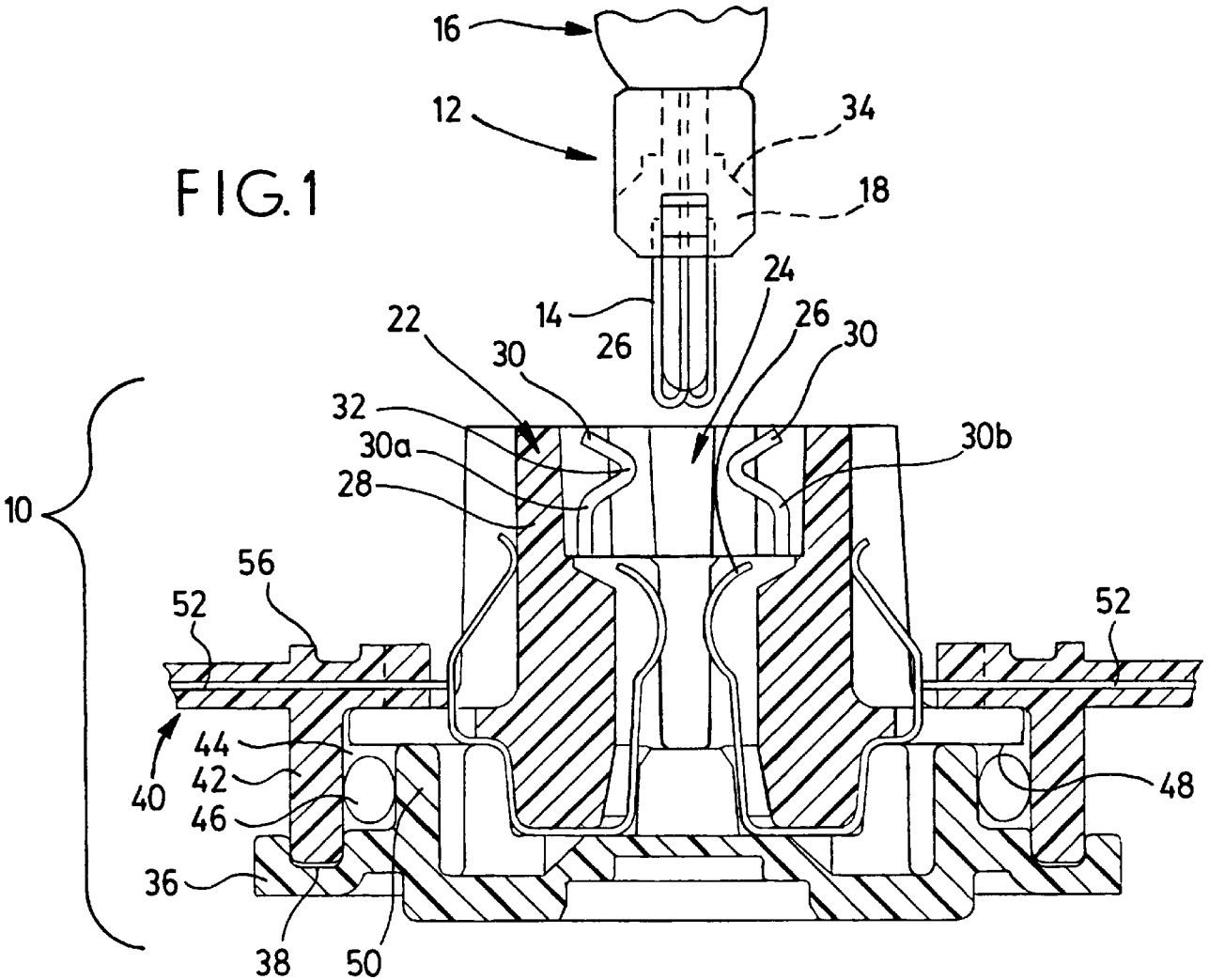
FIG. 1 illustrates a partial cross-sectional view of an embodiment of an assembly of the present invention partially exploded with a portion of a wedge base style lamp illustrated prior to insertion of the lamp into the assembly.

Referring now to the drawings wherein like numerals refer to like parts, FIG. 1 generally illustrates a cross-sectional view of an assembly 10 in which a lamp 12 is inserted. The lamp 12 includes electrical leads 14 extending from a base of the lamp 12 and further from a light transmissive envelope 16. An exterior base frame 18 is secured about a base of the light transmissive envelope 16 and is adapted to maintain the position of the electrical leads 14 extending about the exterior of the base of the light transmissive envelope 16.

Figure 2:
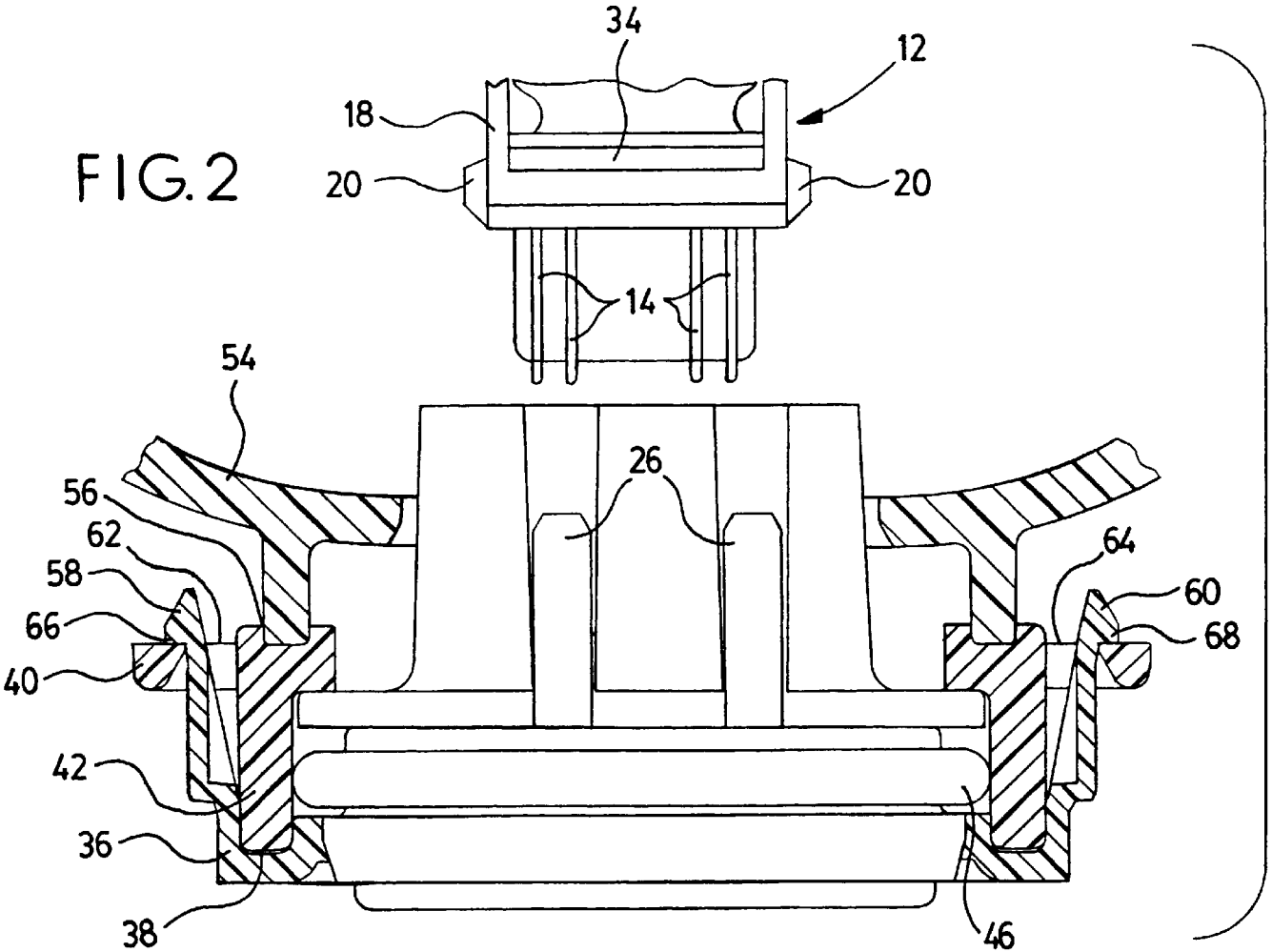
FIG. 2 illustrates a partial cross-sectional view of an embodiment of an assembly of the present invention with a reflector secured onto the assembly and further partially exploded with a portion of a wedge base style lamp illustrated prior to insertion of the lamp into the assembly.
Figure 5:
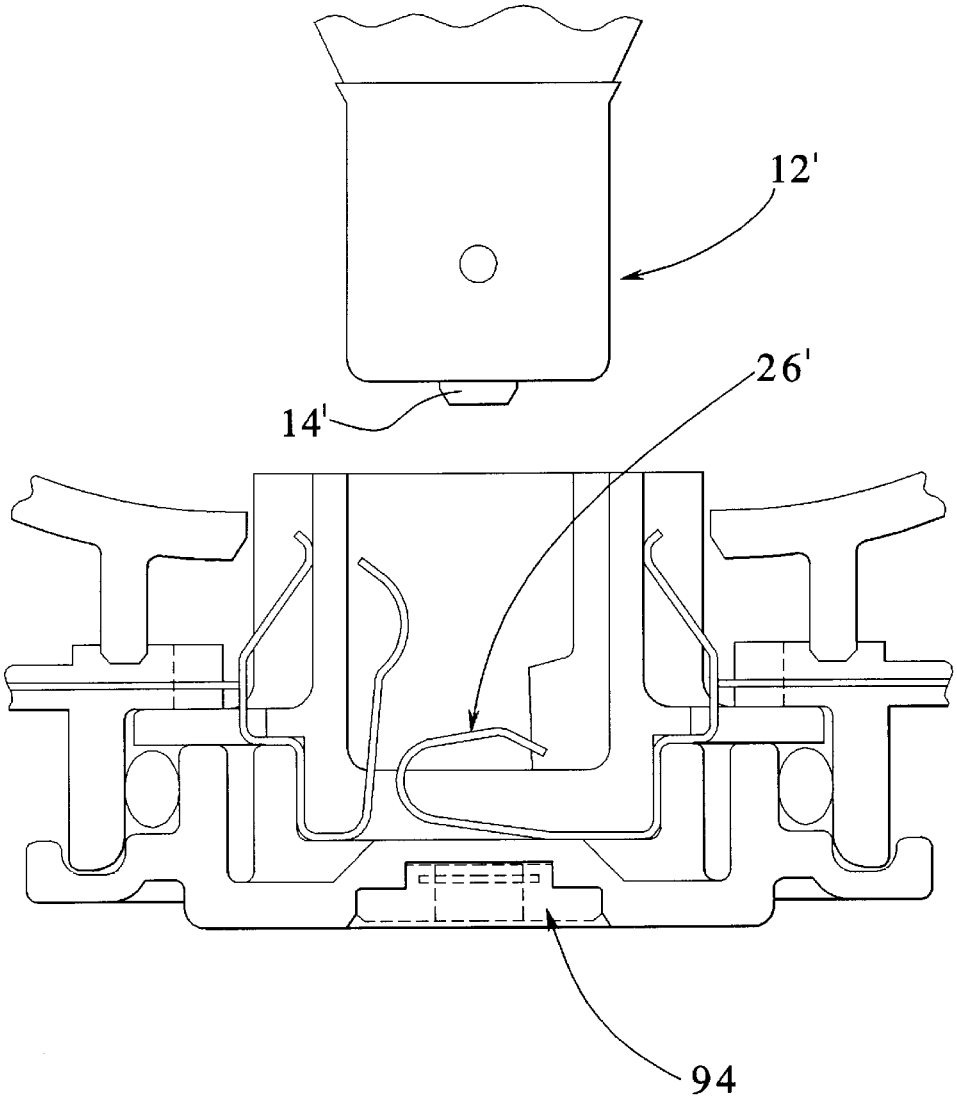
FIG. 5 illustrates a partial cross-sectional view of an alternate embodiment of an assembly of the present invention exploded with a portion of a bayonet based lamp illustrated prior to insertion of the lamp into the assembly.

The leads 14 extend from an interior of the light transmissive envelope 16 in a sealed fashion and are wrapped about the exterior of a base portion of the light transmissive envelope 16 and held in place by the exterior base frame 18 as illustrated in FIGS. 1 and 2. The exterior base frame 18 further includes tabs 20 extending therefrom providing alignment of the lamp 12 when inserted into the assembly 10. of course, other suitable lamps and/or lamp configurations may be implemented by the skilled practitioner to provide electrical connection between the electrical leads 14 of the lamp 12 and the contacts in the assembly 10. Such an alternative lamp is shown in FIG. 5 and described in more detail hereinafter.

As further illustrated in FIG. 1, the assembly 10 includes a number of components. A main component is a lamp socket 22. The lamp socket 22 has an opening 24 for receiving the lamp 12 and providing electrical connection between contacts 26 in the opening 24 of the lamp socket 22. Two contacts 26 are illustrated in the cross-sectional view of FIG. 1. However, as illustrated in plan view in FIG. 3, four contacts 26 are provided for connection to the electrical leads 14.

The contacts 26 extend through the opening 24 of the lamp socket 22 to rest against an outside wall 28 of the lamp socket 22. The lamp 12 is, therefore, insertable into the opening 24 of the lamp socket 22 such that the electrical leads 14 are in electrical contact with the end portions of contacts 26. Lamp clip 30 is positioned in the opening 24 of the lamp socket 22 and adapted to retain the exterior base frame 18 of the lamp 12.

Upon insertion of the lamp 12 into the opening 24 of the lamp socket 22, the lamp 12 is pressed into the opening 24 allowing the lamp clip 30 to receive the exterior base frame 18 wherein the exterior base frame 18 outwardly pushes the biased arms 30*a* and 30*b* of lamp clip 30 until the base frame 18 passes the lamp clip 30 and is then held in place by inward protrusions 32 of the arms 30*a* and 30*b* extending over a top wall 34 of the exterior base frame 18.

The assembly 10 further includes a cap plate 36 on which the lamp socket 22 is secured. The cap plate 36 includes a first recessed section 38 on which a circuit carrier 40 is received. To this end, the circuit carrier 40 includes a wall 42 defining an aperture 44 through which the lamp socket 22 and the cap plate 36 extend. Between the wall 42 and the cap plate 36 with a circumferential wall 50 is an O-ring 46 providing a sealed area between these components of the assembly 10. The O-ring 46 is, therefore, constructed and arranged around a bottom wall 48 of the lamp socket 22 and exterior to an inner circumferential wall 50 of the cap plate 36 and within the wall 42 of the circuit carrier 40.

The circuit carrier 40 further includes sealed circuits 52 extending to each of the contacts 26 providing electrical power to the lamp 12. The sealed circuits 52 within the circuit carrier 40 provide connection paths for signal and power to all or a portion of all of the lamps in an assembly of lamps.

Also illustrated in FIGS. 2 and 5 is a reflector 54 connectable in a recess 56 formed in the circuit carrier 40.

Referring now to FIG. 2, another feature of the cap plate 36 is more clearly illustrated. More specifically, biased arms 58 and 60 are integrally molded to the cap plate 36 capable of insertion through apertures 62, 64 of the circuit carrier 40. Circuit carrier 40 onto the cap plate 36. The biased arms 58, 60 also include legs 66, 68 secured over an edge of the circuit carrier 40 as illustrated in FIG. 2. Therefore, the cap plate 36 cannot be removed from the circuit carrier 40 without positive pressure applied substantially transversely to the length of the biased arms 58, 60 so as to displace the biased arm 58, 60 within its respective aperture 62, 64 enabling the biased arm 58, 60 and hence the cap plate 36 to be removed from the circuit carrier 40.

Figure 3:
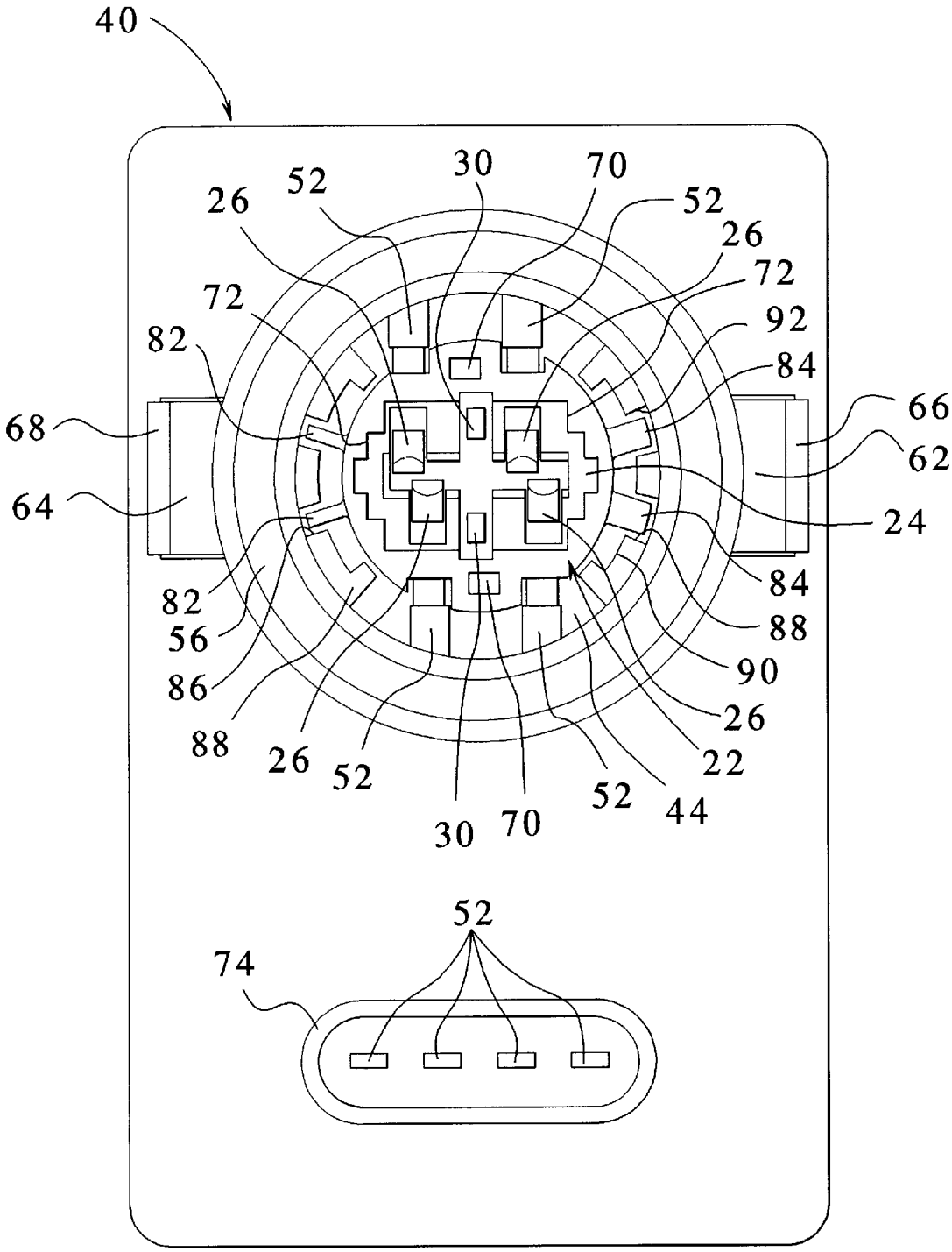
FIG. 3 illustrates a plan view of the circuit carrier of an embodiment of the assembly of the present invention. The circuit carrier is shown as one representation of many possible circuit variations. The circuit paths exit the carrier in a connector suitable to mate with the external circuits.

Referring now to FIG. 3, a plan view of one embodiment of a circuit carrier 40 is illustrated with the cap plate 36 and the lamp socket 22 secured therein. The lamp socket 22 includes apertures 70 for receiving posts extending from the cap plate 36 therein to prevent removal of the lamp socket 22 from the cap plate 36.

The opening 24 of the lamp socket 22 as clearly illustrated in FIG. 3 includes two opposite walls 72 having a stepped configuration allowing receipt of the tab 20 extending from the exterior base frame 18 connected to the light transmissive envelope 16 of the lamp 12 to be received in the widest portion formed between the opposite walls 72. The remainder of the exterior base frame 18 is received within the next widest portion between the opposite walls 72 providing proper orientation of the lamp 12 into the opening 24 and consequently proper alignment of the electrical leads 14 with the contacts 26. As illustrated, the circuit carrier 40 is rectangularly shaped with the sealed circuits 52 extending into the aperture 44 formed by the circuit carrier 40 and continuing into the molded connector 74 of the circuit carrier 40. The molded connector 74 is shown as having a generally oval shape. However, it will be understood that the size and shape of molded connector 74 may vary considerably depending upon the application for which it is intended.

Figure 4:
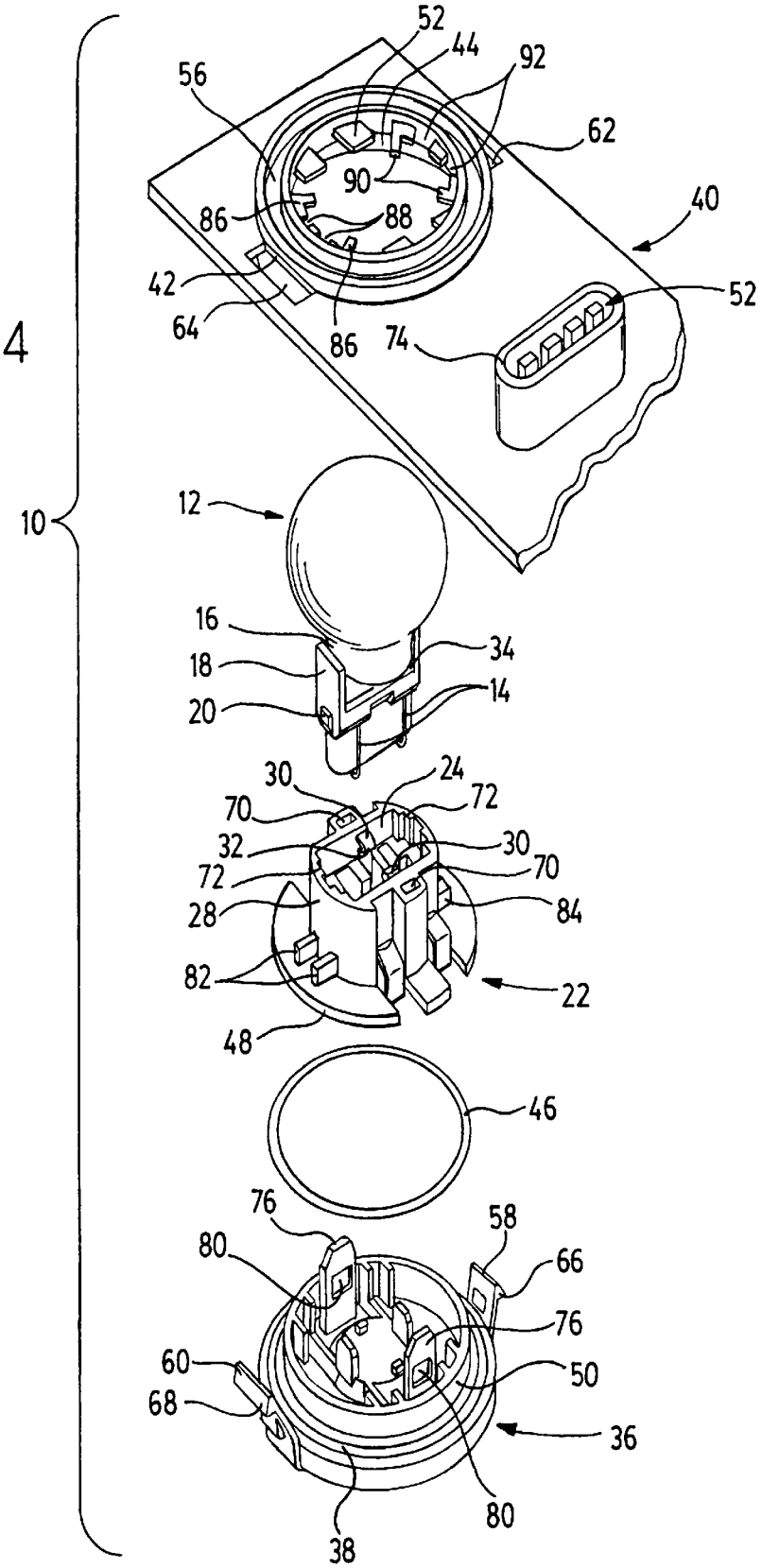
FIG. 4 illustrates an exploded perspective view of an embodiment of the assembly of the present invention including a wedge based lamp for insertion into the assembly.

Referring now to FIG. 4, an exploded view of an embodiment of the assembly 10 of the present invention including the lamp 12 is illustrated. To this end, a cap plate 36, the O-ring 46, the lamp socket 22, the lamp 12 and the circuit carrier 40 are shown.

The assembly 10 is completed by first placing the O-ring 46 onto the cap plate 36 around the inner circumferential wall 50 of the cap plate 36. As previously set forth with reference to FIGS. 1–3, the cap plate 36 includes plug latches 76 receivable into aperture 70 of the lamp socket 22. The plug latches 76 are misaligned and received within the apertures 70 from a bottom wall 48 of the lamp socket 22. The plug latches 76 are received in a manner such that when the plug latches 76 are fully inserted into the apertures 70 of the lamp socket 22, the lamp socket 22 is irremovably secured to the cap plate 36 with the O-ring 46 therebetween.

To this end, an opening 80 is provided in the each of the walls of the plug latches 76 and each opening 80 is secured over out-dent portions (not shown) within the apertures 70 of the lamp socket 22. The out-dent portions are slightly smaller than the opening 80 such that the cap plate 36 is immovably and permanently secured to the lamp socket 22. Further, the cap plate 36, as a result, is precisely and accurately aligned with the lamp socket 22 thereon.

The lamp 12 is then insertable into the lamp socket 22 such that the exterior base frame 18 is attached to the lamp 12 and is aligned into the opening 24 of the lamp socket 22. The top wall 34 of the exterior base frame 18 is inserted into the opening 24 until the top wall 34 is clipped within the inward protrusion 32 of the biased arms 30*a* and 30*b* of the lamp clip 30. Finally, the circuit carrier 40 is insertable over the lamp 12 or can be insertable prior to insertion of the lamp 12 into the lamp socket 22.

The cap plate 36 and lamp socket 22 may only be placed onto the circuit carrier 40 in the manner illustrated. In particular, means are provided for ensuring a proper orientation between the circuit plate 40 and lamp socket 22. In the embodiment shown in the illustrations, lamp socket 22 includes a first set of projecting keys 82 on one side and a second set of projecting keys 84 on the other side. The opening 44 in circuit plate 40 includes on one side projecting ribs 86 which define apertures 88 and on the other side projecting ribs 90 which define apertures 92. The keys 82 and 84 have different widths and the corresponding apertures 88 and 92 have corresponding different widths for receiving keys 82 and 84. Thus, the lamp socket 22 will only fit into the opening 44 of circuit plate 40 in the desired orientation. It will also be understood that other suitable means for positioning lamp socket 22 within opening 44 may be utilized. For example, in an alternate embodiment, the biased arms 58, 60 and corresponding apertures 62, 64 could have different widths to only allow the lamp socket 22 and circuit plate 40 to be assembled in the desired orientation.

As a result of the foregoing, the lamp socket and cap plate assembly may be pushed into the molded circuit carrier at each lamp location opening. Electrical connections for the lamp socket are provided within each opening. The inner connections are contained inside the sealed area of the socket. The lamp socket and cap plate assembly is easily removed from the circuit carrier by squeezing the biased arms and pulling the assembly out of the circuit carrier. This permits easy lamp replacement without damage to the lens seals.

The sealing of the assembly is provided by the one-piece circuit carrier covering the lamp opening. The O-ring under the cap plate mates with a circular molded rib on the circuit carrier. All dimensions effecting the mating surfaces of the O-ring seal are controlled by molded parts.

The circuit carrier is sealed to the back of a lens reflector before the lamps and/or lamp sockets are inserted. This attachment creates a seal around each of the lamp openings. Bonding between the circuit carrier and lens reflector can be accomplished by using adhesives, hot plate reflow melting, ultrasonic bonding, or the like. To make the attachment, the reflector has a low circular ring molded around each lamp opening. The height of the ring controls the location of the lamp focal point.

The materials used in the molded circuit carrier may be similar to those used in the lens reflector. This permits easy bonding techniques to be used between the similar circuit carrier and the reflector materials. High temperature glass filled plastic may be used in the lamp socket to provide stability for the lamp and lamp socket contacts when exposed to the lamp heat. Material of the mounting plate may be Polypropylene providing flexibility to the latches, the mounting plate and the socket assembly.

In the alternate embodiment shown in FIG. 5, the assembly 10 is substantially the same as previously described except for the lamp 12', the contact 26' and a vent 94 provided in the cap plate 36. In particular, lamp 12' is a bayonet based lamp having a lead or projection 14' positioned to contact the bent portion of contact 26' which is positioned in the bottom of lamp socket 22. While both wedge based lamps and bayonet based lamps have been shown in detail, it will be understood that the lamp type and style may vary considerably within the scope of this invention.

The embodiment shown in FIG. 5 also includes a vent 94 added to the center of the cap plate 36 to relieve pressure within the sealed lens assembly. The vent 94 may be a premolded assembly bonded into a cored pocket in the mounting. The vent may contain a fabric (not shown) for excluding moisture from the lens assembly while still allowing air to move in or out of the sealed area surrounding the lamps.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A method for assembling a sealed plug-in lamp assembly, the method comprising the steps of:

providing a lamp having a plurality of electrical leads extending therefrom;

providing a lamp socket having a plurality of electrical contacts; said contacts include a plurality of end portions within the lamp socket, and extending around to an exterior of the lamp socket to rest against a vertical sidewall of the lamp socket;

inserting the lamp into the lamp socket providing electrical connection between the plurality of electrical leads and the plurality of end portions of the contacts within the interior of the lamp socket;

providing a circuit carrier having a plurality of sealed circuits molded into the circuit carrier; and inserting the lamp socket into the circuit carrier providing electrical connection between the plurality of contacts resting against the vertical side wall and the plurality of sealed circuits in a sealed manner.

2. The method of claim 1 further comprising the step of:

mounting the lamp socket on a cap plate prior to inserting the lamp socket into the circuit carrier.

3. The method of claim 1 further comprising the step of:

providing an O-ring to seal the electrical connection.

4. The method of claim 1 further comprising the step of:

providing means for aligning the lamp for proper insertion of the lamp in the lamp socket.

* * * * *